US005735197A

United States Patent [19]

Kleine

[11] Patent Number: 5,735,197

[45] Date of Patent: Apr. 7, 1998

[54] OIL FILTER COMPACTOR

[75] Inventor: Donald R. Kleine, 9201 Isaac St., Santee, Calif. 92071

[73] Assignee: Donald R. Kleine

[21] Appl. No.: 264,305

[22] Filed: Jun. 23, 1994

[51] Int. Cl.[6] ..... B30B 9/06; B30B 15/30

[52] U.S. Cl. ..... 100/127; 100/189; 100/192; 100/215; 100/232; 100/233; 100/282

[58] Field of Search ..... 100/126, 127, 100/179, 189, 191, 192, 215, 216, 232, 233, 282

[56] References Cited

U.S. PATENT DOCUMENTS

| | | | |
|---|---|---|---|
| 375,078 | 12/1887 | Livengood | 100/191 |
| 524,771 | 8/1894 | Stokely | 100/192 |
| 657,607 | 9/1900 | Luzatto | 100/189 |
| 851,131 | 4/1907 | Gutridge | 100/191 |
| 1,523,012 | 1/1925 | Gettelman | 100/192 |
| 1,602,626 | 10/1926 | Power | 100/191 |
| 1,819,480 | 8/1931 | Paxton | 100/179 |
| 3,621,775 | 11/1971 | Dedio et al. | 100/191 |
| 3,776,128 | 12/1973 | Morris | 100/53 |
| 4,603,909 | 8/1986 | Le Jeune | 100/127 |
| 4,667,832 | 5/1987 | Reinfeld | 209/636 |
| 4,787,308 | 11/1988 | Newsom et al. | 100/50 |
| 4,809,600 | 3/1989 | Yamamoto et al. | 100/193 |
| 5,125,331 | 6/1992 | Wood | 100/37 |
| 5,136,934 | 8/1992 | Darby, Jr. | 100/125 |
| 5,174,199 | 12/1992 | King et al. | 100/48 |
| 5,182,988 | 2/1993 | Styfhoorn | 100/98 R |
| 5,215,007 | 6/1993 | Sebright et al. | 100/127 |
| 5,274,906 | 1/1994 | ter Haar | 29/700 |
| 5,279,215 | 1/1994 | Harder | 100/48 |
| 5,377,584 | 1/1995 | Egretier | 100/189 |

FOREIGN PATENT DOCUMENTS

| | | | |
|---|---|---|---|
| 188926 | 7/1888 | France | 100/191 |
| 508910 | 10/1920 | France | 100/191 |
| 715716 | 12/1931 | France | 100/191 |
| 35371 | 4/1886 | Germany | 100/192 |
| 592715 | 2/1934 | Germany | 100/127 |
| 32168 | 7/1910 | Sweden | 100/189 |
| 406762 | 7/1974 | U.S.S.R. | 100/215 |

OTHER PUBLICATIONS

Ketema Process Equipment Division, "Dewatering Press", Bulletin RR-200(r), 1988.

*Primary Examiner*—Stephen F. Gerrity

[57] ABSTRACT

A compactor for metal articles such as cans or oil filters has a feed that receives metal articles from a hopper or feed tube and feeds them into an elongated tapered compaction die. The compaction die has a cross-sectional area that decreases or tapers from the rearward end of the die to the forward end of the die. A reciprocating ram operates near the wider end of the tapered compaction die. The articles enter the compaction die at a location forward of the ram when the ram is in a retracted position. When the ram is actuated, it moves to an extended position, thereby forcing the articles forward in the compaction die. The ram then retracts, allowing additional articles to enter the compaction die. As the ram operates in this reciprocating manner, it moves additional articles forward in the compaction die and adds them to the increasing mass of articles. As the mass of articles grows and moves forward, it is increasingly compacted because it is forced through portions of the compaction die having decreasing cross-sectional areas. The compacted mass is extruded at the narrower end of the compaction die.

30 Claims, 3 Drawing Sheets

OIL FILTER COMPACTOR

BACKGROUND OF THE INVENTION

1. Field of the Invention

The present invention relates generally to compactors or crushers for metal articles and, more specifically, to a compactor for bulk-fed oil filters.

2. Description of the Related Art

Devices for compacting cans and similar metal articles for recycling or disposal typically comprise a compaction chamber and one or more reciprocating rams, which are typically hydraulically actuated. A conveyor may feed the cans in bulk quantities into the compaction chamber. When the chamber is filled, the ram is actuated. The ram then enters the compaction chamber and compresses the cans between it and a wall of the chamber. The chamber may have a door that opens to eject the compacted mass. Examples of such compactors are disclosed in U.S. Pat. No. 4,787,308, issued to Newsom et al. and U.S. Pat. No. 4,601,238, issued to Davis, Jr. et al. The compaction chamber of compactors for aluminum beverage cans typically includes a drain for allowing any residual liquids in the cans to escape when the cans are compacted.

Used oil filters, which consist of a metal can containing a paper filter element saturated with residual oil, may be compacted in a manner similar to that used for compacting other types of cans. It is desirable to separate and collect the residual oil from the remainder of the filter because the oil as well as the scrap metal can be recycled. (The filter element is incinerated in the scrap metal smelting process and, in fact, may add beneficial carbon to the metal.) A compactor having the conventional structure described above cannot efficiently extract oil because the compaction pressure is only sufficient to squeeze out a small percentage of the residual oil if filters are compacted in bulk quantities. To maximize residual oil extraction using a conventional compactor, filters may be shredded between rotating blades and then spun in a centrifuge prior to compaction. A process including a shredding step, however, is less economical. Oil filter compactors have been developed that maximize residual oil extraction by compacting filters singly, but such compactors have a very low throughput.

It would be highly desirable to provide a compactor that feeds articles such as cans or oil filters in bulk and compacts them in an essentially continuous manner. Such a compactor should maximize extraction of any residual liquid. These problems and deficiencies are clearly felt in the art and are solved by the present invention in the manner described below.

SUMMARY OF THE INVENTION

The present invention comprises a compactor for metal articles such as cans or oil filters. The metal articles are continuously fed from a hopper and/or feed tube into an elongated compaction die. The compaction die may have any suitable construction and any cross-sectional shape, but the interior of at least a portion of it should have a cross-sectional area that decreases or tapers in a direction from the rearward end of the die toward the forward or exit end of the die. In an exemplary embodiment, the compaction die is a hollow metal tube having walls defining a rectangular cross-sectional shape. In this exemplary embodiment, the walls provide the primary source of the tapering cross-sectional area. Nevertheless, as described below, the compaction die may include one or more members that cooperate with the walls of the die to provide the taper or contribute to the taper. The taper may be of any suitable type, such as a linear taper. Although in the exemplary embodiment the compaction die has a construction defined by a solid, integral tube, it may be defined by multiple interconnected members in other embodiments.

A reciprocating ram operates near the wider end of the tapered compaction die. The articles enter the compaction die at a location forward of the ram when the ram is in a retracted position. When the ram is actuated, it moves to an extended position, thereby forcing the articles forward in the compaction die. The ram then retracts, allowing additional articles to enter the compaction die. As the ram operates in this reciprocating manner, it moves additional articles forward in the compaction die and adds them to the increasing mass of articles. As the mass of articles grows and moves forward, it is increasingly compacted because it is forced through portions of the compaction die having decreasing cross-sectional areas.

The wedge or inclined plane principle utilized by the compaction die amplifies the compaction force provided by the ram. Compaction forces sufficient to reduce the original volume of the filters by 80 percent can easily be generated. If articles are added in a continuous manner at the wider end of the compaction die, the compacted metal is extruded in a substantially continuous manner at the narrower end of the compaction die.

To allow a mass of articles to form in an initially empty compaction die that is sufficient to generate the initial compaction force, the compaction die preferably includes means for restricting the movement of articles in the compaction tube, such as by blocking the interior of the compaction die or otherwise reducing its cross-sectional area. For example, a hinged door or plate may move toward the interior of the compaction die when the mass of articles is insufficient to sustain compaction and then be pushed outward and away by the increasing size of the mass of articles.

As noted above with respect to the tapered shape of the compaction die, the means for restricting the movement of articles in the compaction die may also contribute to the taper of the compaction die or even provide the sole source of the taper. In an embodiment illustrative of the latter, the compaction die may have walls or interconnected members that define a constant cross-sectional area along the length of the compaction die, but an elongated hinged plate may be angled inwardly in the interior of the compaction die to provide the sole source of the taper. If the compaction die has walls or members that define a tapered cross-sectional area, the compaction die may have a hinged plate that further contributes to the taper.

The means for generating the restriction force may be gravity-based, such as would occur if, using the example of a hinged plate, the weight of the door itself were to bias the plate toward the interior of the compaction die; it may be resilient, such as would occur if a spring, an elastomeric member or other source of potential energy were to bias the plate toward the interior of the compaction die; or it may even be active, such as would occur if a hydraulic or other type of actuator were to move the door toward the interior of the compaction die.

The means for controlling or regulating the amount of restriction operates in response to the size of the mass of articles. For example, the mass of articles may push (against the restriction force) a hinged door away from the interior of the compaction die. Active control means, such as an electromechanical system that senses the size or degree of compaction of the mass of articles or compaction ram force and, in response, controls an active restriction force generating means, may also be suitable.

The restriction means may perform the dual functions of allowing a sufficient mass of articles to build that compaction is thereafter self-sustaining and also thereafter regulating the degree of compaction to maintain consistency. Nevertheless, a means for maintaining compaction consistency may be provided that is separate from the means for restricting the movement of articles in the compaction die upon beginning operation.

The compaction die may have suitable orifices along its length to allow any residual liquids in the articles to drain. The orifices may have any suitable shape, such as frustoconical, cylindrical or rectangular, and may be distributed at any suitable spacing and in any suitable manner, such as that which forms a network of holes, perforations or channels, or forms a mesh or grille. The drained liquids may be collected in a pan beneath the tube for recycling or disposal.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
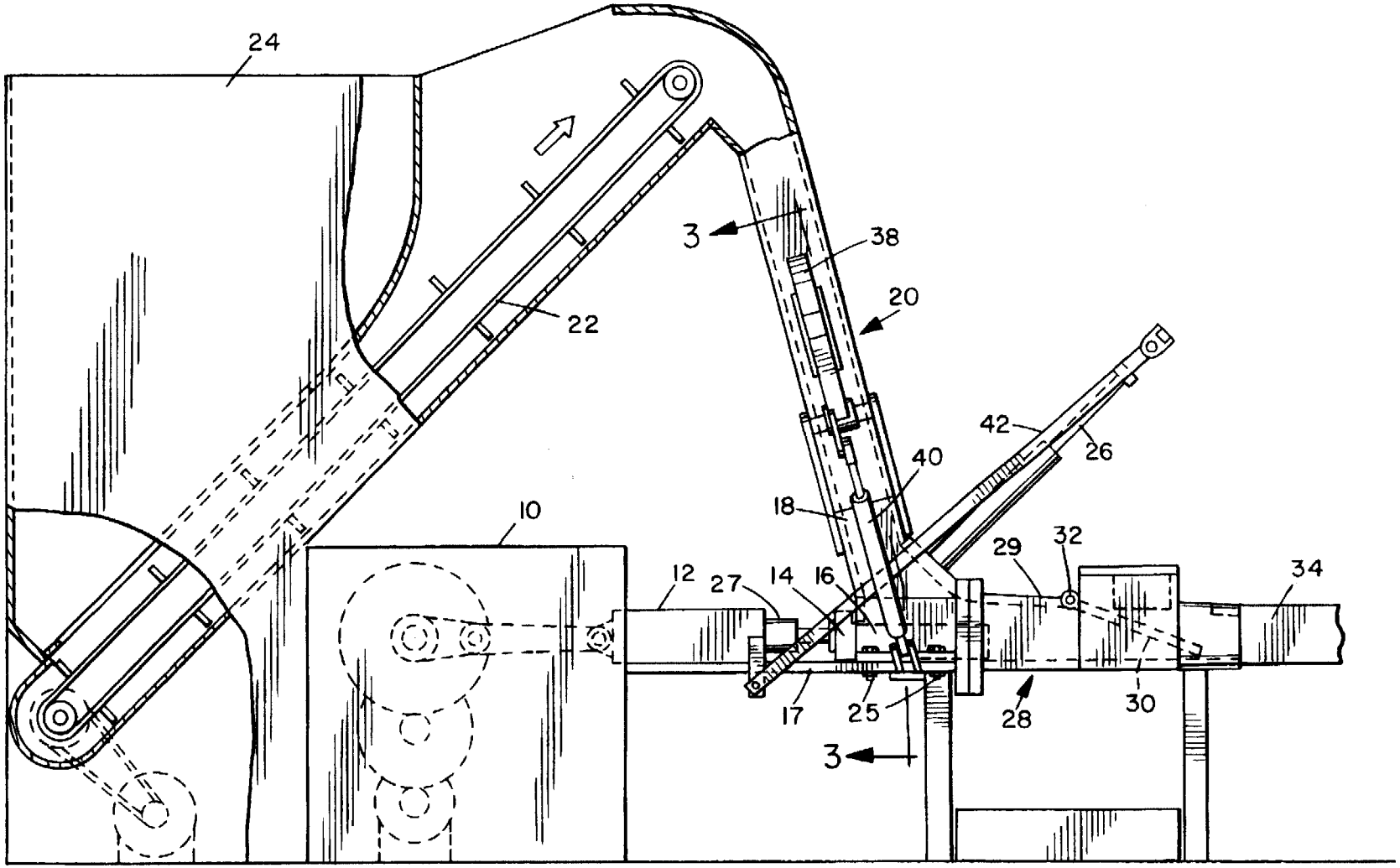
FIG. 1 is a side elevation view of the complete apparatus, with portions cut away.
Figure 2:
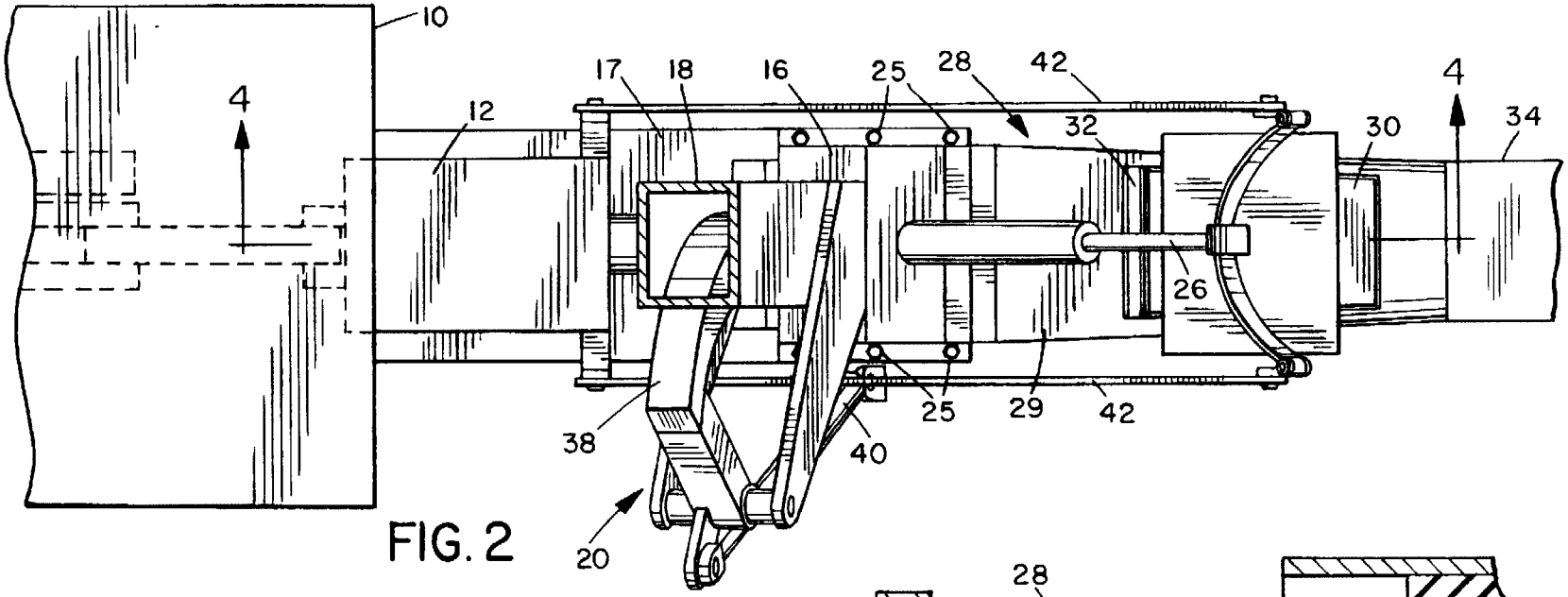
FIG. 2 is a top plan view with the conveyor and a portion of the feed chute omitted.

As illustrated in FIG. 1, a punch press 10 of the well-known flywheel-actuated type commonly used for stamping sheet metal, has a ram carriage 12. Using a suitable control system (not shown), punch press 10 generates successive continuous strokes, each providing at least a 100 ton but preferably a 200 ton force to ram carriage 12. Ram carriage 12 is, in turn, connected to a ram 14 inside a charge box 16 having a rectangular cross-sectional shape. Punch press 10 thus reciprocates ram 14 in charge box 16 between a retracted position and an extended position. The lower end of a generally vertical feed chute 18 opens into the rearward end of charge box 16. A tamper 20 is located in feed chute 18. A conveyer 22 picks up articles to be compacted from a storage hopper 24 in and drops them into the upper end of chute 18. A secondary ram 26 that operates in synchronism with ram 14 facilitates movement of the articles to a position forward of ram 14 when ram 14 is in the retracted position.

Charge box 16 is mounted on a support 23 using shear bolts 25. If the shear force experienced by shear bolts 25 in response to a forward stroke of ram carriage 12 exceeds a safety threshold, such as approximately 400,000 PSI, shear bolts 25 shear off, thereby allowing charge box 16 to move forward and relieve the stress. This mounting arrangement prevents severe damage to the invention if, for example, a large or extremely hard article causes a jam to occur in the compaction path. As an additional safety measure, a fluid spring 27 connects ram carriage 12 to ram 14. Fluid spring 27 comprises a sealed, fluid-filled cylinder 33 connected to ram carriage 12 and a piston 31 inside cylinder 33 connected to ram 14. The fluid, which is preferably an inert gas such as nitrogen, surrounds piston 31 and cushions ram carriage 12 against the adverse effects of severe impact shocks during forward strokes.

Figure 6:
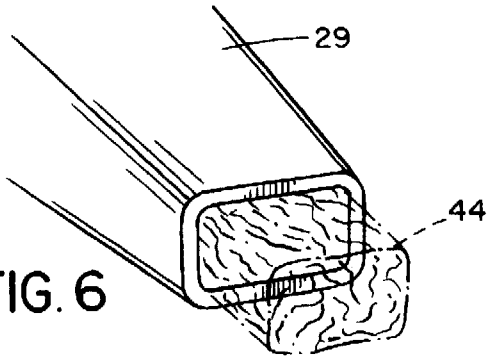
FIG. 6 is a perspective view of the end of the compaction die, showing the extrusion of a mass of compacted material.

The forward end of charge box 16 is connected to the rearward end of a compaction die 28. Compaction die 28 comprises a hollow compaction tube 29 having a generally rectangular cross-sectional shape and planar walls. Compaction tube 29 has a cross-sectional area that decreases from its rearward end toward its forward end. The rearward end of compaction tube 29 has substantially square corners, but the forward end has radiused corners, as shown in FIG. 6. The decrease in cross-sectional area is linear because the walls are planar. The width preferably decreases from 9½ inches at the rearward end to 8¾ inches at the forward end, and the height preferably decreases from 7 inches at the rearward end to 6½ inches at the forward end. These decreasing dimensions correspond to a decrease in cross-sectional area of approximately 0.36 square inches per inch of forward distance in a compaction die tube that is 27 inches in length.

Compaction die 28 further includes an elongated plate 30 mounted with a hinge 32 on the upper wall of compaction tube 29. A discharge chute 34 is connected to the forward end of compaction tube 29.

Figure 3:
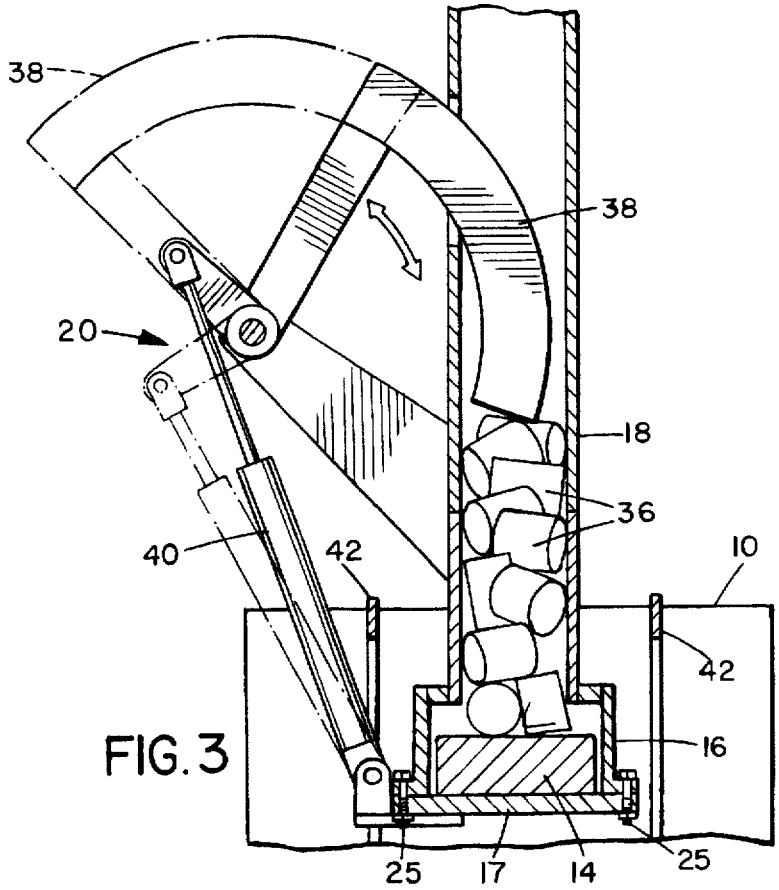
FIG. 3 is an enlarged sectional view taken on line 3—3 of FIG. 1.

In operation, conveyer 22 picks up oil filters 36 from hopper 24 and drops them into the upper end of feed chute 18. As illustrated in FIG. 3, tamper 20 comprises an arcuate tamper arm 38 and a tamper actuation cylinder 38. Tamper actuation cylinder 40, which may be hydraulic, is periodically actuated using suitable controls (not shown) to swing tamper arm 38 through an opening in the wall of feed chute 18, as shown in FIG. 3. Tamper arm 38 thus urges oil filters 36 in feed chute 18 downward toward charge box 16. When ram 14 is in the retracted position, shown in phantom line in FIG. 4, oil filters 36 are fed into charge box 16 forward of the forward end of ram 14. A pushrod or linkage 42 between ram carriage 12 and secondary ram 26 reciprocates secondary ram 26 in synchronism with ram 14. When ram 14 is in the retracted position, secondary ram 26 is in an extended position, shown in phantom line in FIG. 4. Secondary ram 26 thus inhibits buildup of oil filters 36 at the juncture 50 between feed tube 18 and charge box 16 by pushing oil filters 36 downward in front of the retracted ram 14. Juncture 50 has an inner surface with a varying curvature to connect a portion of the outlet end of feed tube 18 to charge box 16.

Figure 4:
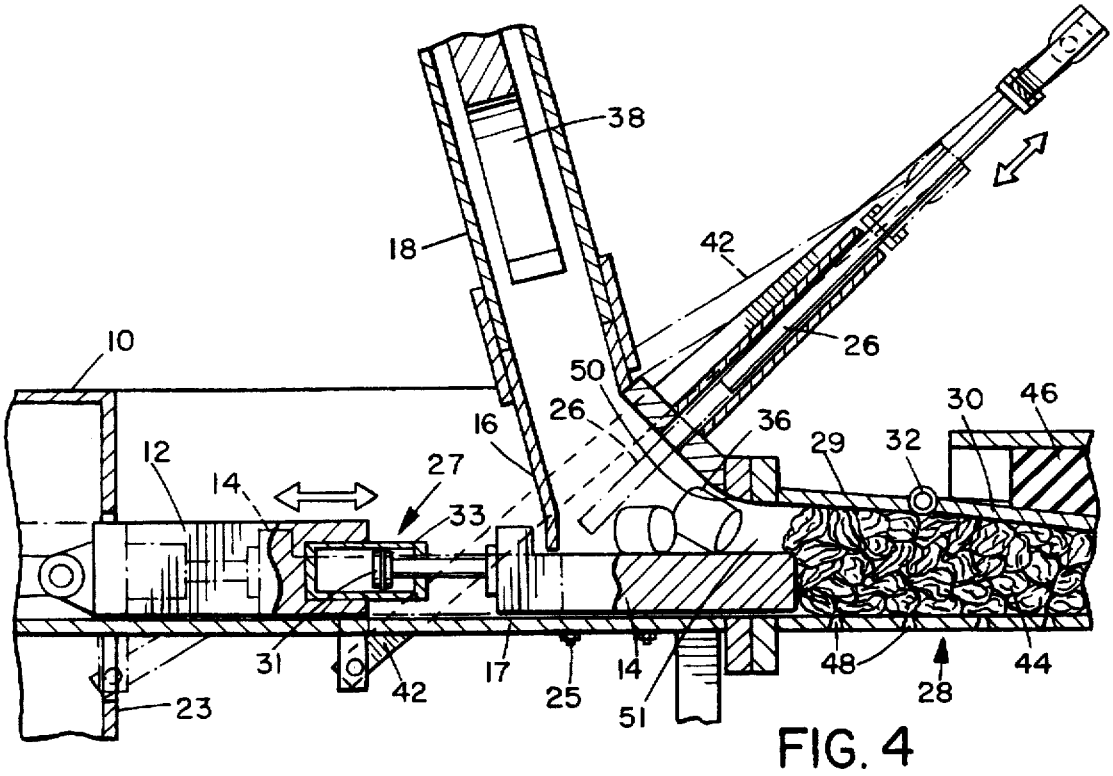
FIG. 4 is a sectional view taken on line 4—4 of FIG. 2.

When punch press 10 initiates a stroke, ram 14 moves forward to the extended position in which it is shown in FIG. 4. The size and shape of the primary ram 14 relative to the inlet opening of the compaction die 28 creates a clearance space 51 between the top of the primary ram 14 and the inner surface of the compaction die 28. When ram 14 is in the extended position, secondary ram 26 is in the retracted position in which it is shown in FIG. 4. The forward movement of ram 14 urges oil filters 36 in a forward direction through charge box 16 and into compaction tube 29.

Upon beginning operation, the free end of plate 30 rests on the bottom wall of compaction tube 29. The first few oil filters 36 reaching the forward end of compaction tube 29 are thus blocked against further forward movement. The weight of plate 30 is sufficient to prevent the first few oil filters 36 from swinging it upward. As the mass 44 inside compaction tube 29 increases, the tapering cross-sectional shape increasingly contributes to the resistance of oil filters 36 against forward movement. When the mass 44 increases to the point where it effectively plugs compaction tube 29, the addition of further oil filters 36 will urge mass 44 forward and compact it. The first few oil filters 36 that reached the forward end of compaction tube 29 after initially beginning operation may, however, swing plate 30 upward and exit compaction tube 29 without being significantly compacted. (They may be tossed back into hopper 24.) Nevertheless, as additional articles are rammed into compaction tube 29, the remaining mass 44 emerges at the forward end of compaction tube 29 as an extruded slab of compacted metal. Plate 30 is thus moved further upwardly and is held in a substantial open position by mass 44. An elastomeric stop 46, made of a block of polyurethane, blocks further upward movement of plate 30. With door 30 pressed firmly against stop 46 by mass 44, plate 30 functions in the same manner as any wall of compaction tube 29 by providing an angled surface.

Once the mass 44 has increased to the point where it effectively plugs compaction tube 29, compaction is self-sustaining so long as oil filters 36 are fed continuously and consistently. Nevertheless, variations in article feed rate will occur if oil filters 36 are of different sizes or shapes, and some variation is inherently caused by the random orientations in which the oil filters 36 enter charge box 16. To enhance compaction consistency despite these variations, resilient stop 46 biases plate 30 downwardly toward the interior of compaction tube 29. If mass 44 decreases slightly, plate 30 will swing downwardly slightly in response to resilient stop 46 to effectively increase the taper of compaction tube 29 and thereby maintain the same level of compaction.

Although the preferred taper of the cross-sectional area of compaction tube 29 of approximately 0.36 square inches per inch of forward distance may appear small, it is sufficient to generate enormous compaction forces, particularly as used in combination with the above-described means for maintaining compaction consistency. In response to the 200 ton force of punch press 10, compaction tube 29 can generate a compaction force of approximately 12,000 PSI. Nevertheless, a taper less than approximately one inch per inch of forward distance can create a compaction force in excess of 9,000 PSI, which is suitable for compacting oil filters 36, without requiring a substantially more powerful punch press 10.

As illustrated in FIG. 6, the forward end of compaction tube 29 has a rectangular shape with rounded or radiused corners. The radiused corners enhance compaction and also inhibit sharp edges on the mass 44 of compacted filters that is extruded there.

Figure 5:
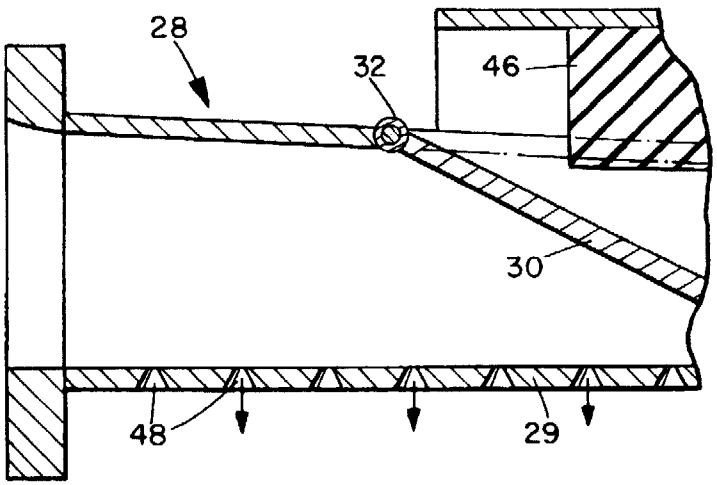
FIG. 5 is a further enlargement of a portion of FIG. 4, showing the drain holes.

As illustrated in FIGS. 4 and 5, the wall of compaction tube 29 has orifices 48 through which any residual oil squeezed from mass 44 can drain. Orifices 48 have a frusto-conical shape, with the narrower end opening into the interior of compaction tube 29. The frusto-conical shape of orifices 48 minimizes the possibility of clogging because the narrow end of the cone shears off particles from mass 44 that would clog a cylindrical orifice but which fall through a conical orifice 48 without clogging it.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A compactor for compacting articles, comprising:

a compaction die oriented generally along an axis, said compaction die having an open interior, an inlet end, and an outlet end forward of said inlet end, said inlet end having a cross-sectional area, said open interior having a cross-sectional area decreasing in a forward direction from said inlet end to said outlet end along said axis;

a restrictor connected to the compaction die at said outlet end and comprising a portion movable in response to force generated by said articles, said restrictor restricting movement of said articles in a forward direction through said interior of said compaction die;

a primary ram movable along said axis for urging said articles into said interior of said compaction die, said primary ram having a front end and a cross-sectional area smaller than said cross-sectional area of said inlet end of said compaction die;

an actuator for moving said primary ram front end between a primary ram retracted position and a primary ram extended position, said primary ram moving in a direction from said inlet end of said compaction die toward said outlet end of said compaction die when said primary ram front end moves from said retracted position to said extended position;

a feed for providing said articles to said open interior of said compaction die at a feed position forward of said primary ram retracted position and rearward of said primary ram extended position;

said feed having an inlet portion and an outlet portion, and a juncture portion at an article feeding position connecting the outlet portion of the feed to the compaction die inlet end, with the juncture portion having an inner surface which has a varying curvature; and a secondary ram located at said juncture portion, said secondary ram moving between a secondary ram retracted position and a secondary ram extended position, said secondary ram moving from said retracted position to said extended position in a direction having a component of motion along said compaction die axis and from said outlet end toward said inlet end of said compaction die, the secondary ram located along an axis, and an angle between the compaction die axis and the secondary ram axis being generally equal to 45 degrees.

2. The compactor claimed in claim 1, wherein said secondary ram moves in synchronism with and in response to the motion of said primary ram, said secondary ram is in said secondary ram retracted position when said primary ram is in said primary ram extended position, and said secondary ram is in said secondary ram extended position when said primary ram is in said primary ram retracted position.

3. The compactor claimed in claim 1, wherein said restrictor comprises a hinged plate movable toward said interior of said compaction die.

4. The compactor claimed in claim 3, further comprising resilient means for biasing said plate toward said interior of said compaction die.

5. The compactor claimed in claim 4, wherein said resilient means comprises an elastomeric block.

6. The compactor claimed in claim 1, wherein said compaction die comprises a hollow metal tube and said restrictor comprises a plate hingedly mounted to said tube, said plate movable in a direction toward said interior of said compaction die.

7. The compactor claimed in claim 6, further comprising a resilient member for biasing said plate toward said interior of said compaction die.

8. The compactor claimed in claim 7, wherein said resilient member is an elastomeric block.

9. The compactor claimed in claim 1, wherein said feed receives said articles from a position above said compaction die and said articles are provided at least partially in response to gravity.

10. The compactor claimed in claim 9, wherein said feed comprises a feed tube oriented generally perpendicularly to said compaction die.

11. The compactor claimed in claim 9, wherein said feed further comprises:

a charge box attached to said inlet end of said compaction die; and a feed tube having a lower end attached to an upper portion of said charge box at said feed position;

said primary ram reciprocating at least partially inside said charge box.

12. The compactor claimed in claim 11, wherein said charge box is mounted to a support using a plurality of shear bolts.

13. The compactor claimed in claim 11, further comprising a tamper moving at least partially within said feed tube.

14. The compactor claimed in claim 13, wherein said tamper has an arcuate shape and enters said feed tube through an opening in a wall of said feed tube from a tangential direction.

15. The compactor claimed in claim 1, wherein said compaction die has drain orifices distributed along its length.

16. The compactor claimed in claim 15, wherein each drain orifice comprises a frusto-conical cavity between an inside surface and an outside surface of said compaction die, said cavity having an end with a smaller cross-sectional area at said inside surface and an end with a larger cross-sectional area at said outside surface.

17. The compactor claimed in claim 1, wherein said cross-sectional area of said compaction die decreases by less than one inch per inch of forward distance.

18. The compactor claimed in claim 17, wherein said cross-sectional area of said compaction die decreases by 0.36 inches per inch of forward distance.

19. The compactor claimed in claim 1, wherein said compaction die generates a compaction force in excess of 9,000 PSI.

20. The compactor claimed in claim 19, wherein said compaction die generates a compaction force of approximately 12,000 PSI.

21. The compactor claimed in claim 1, wherein said outlet end and said inlet end of said compaction die have generally rectangular shapes.

22. The compactor claimed in claim 21, wherein said outlet end of said compaction die has rounded corners.

23. The compactor claimed in claim 21, wherein said inlet end of said compaction die is approximately 7 inches by 9½ inches, and said outlet end of said compaction die is approximately 6½ inches by 8¾ inches.

24. The compactor claimed in claim 1, wherein said actuator comprises a flywheel-actuated punch press.

25. The compactor claimed in claim 24, wherein said punch press generates at least 100 tons of force.

26. The compactor claimed in claim 25, wherein said punch press generates 200 tons of force.

27. The compactor claimed in claim 1, wherein said compaction die comprises a hollow metal tube having an inside surface and an outside surface.

28. The compactor claimed in claim 27, wherein said compaction die has drain orifices distributed along its length.

29. The compactor claimed in claim 28, wherein each drain orifice comprises a frusto-conical cavity between said inside surface and said outside surface of said compaction die, said cavity having an end with a smaller cross-sectional area at said inside surface and an end with a larger cross-sectional area at said outside surface.

30. The compactor claimed in claim 1, wherein a clearance space is present between the top of the primary ram and the inner surface of the compaction die.

* * * * *